US005439201A

United States Patent [19]

Landreville

[11] Patent Number: 5,439,201

[45] Date of Patent: Aug. 8, 1995

[54] FENCE BRACKET

[75] Inventor: Charles Landreville, Dacre, Canada

[73] Assignee: 832276 Ontario Inc., Dacre, Canada

[21] Appl. No.: 230,745

[22] Filed: Apr. 21, 1994

[51] Int. Cl.[6] ..... E04H 17/22

[52] U.S. Cl. ..... 256/65; 256/69; 52/665; 52/712

[58] Field of Search ..... 256/30, 31, 24, 65, 256/64, 68, 69, 59, DIG. 4, 47; 403/232.1, 234, 231, 241; 52/665, 655.1, 712; 248/121

[56] References Cited

U.S. PATENT DOCUMENTS

| | | | |
|---|---|---|---|
| 3,615,110 | 10/1971 | Fugate | 256/59 X |
| 3,863,900 | 2/1975 | Dagiel et al. | 256/65 X |
| 3,945,741 | 3/1976 | Wendt | 403/231 X |
| 4,318,628 | 3/1982 | Mancini | 403/232.1 X |
| 4,527,375 | 7/1985 | Braginetz | 52/712 |
| 5,152,507 | 10/1992 | Lee | 256/65 X |
| 5,190,268 | 3/1993 | Espinueva | 403/232.1 X |
| 5,217,317 | 6/1993 | Young | 403/232.1 |

*Primary Examiner*—Randolph A. Reese
*Assistant Examiner*—Heather Chun Shackelford
*Attorney, Agent, or Firm*—R. A. Wilkes; R. G. Hendry

[57] ABSTRACT

The present invention relates to a bracket for mounting fence rails and other items to common rolled metal posts, including a flat front face and a rearwardly projecting apertured web. Most commonly these are T-shaped in cross-section. The bracket includes a front plate substantially wider than the front face of the post, two rear plates behind the front plate attached to the edges of the front plate, and two mounting plates projecting rearwardly from the edges of the rear plates. The mounting plates have apertures in registration with each other. The mounting plates are attachable to the apertured web to locate the front plate in abutting relationship with the front face of the post. The front, rear, and mounting plates define a slot shaped to received the post. The width of the front plate is sufficient to include apertures for fasteners to secure fencing members, which are not obstructed by the front face of the post. A strap can be threaded through these apertures to secure a fence member. The bracket is formed of stamped sheet metal bent to shape, or as a molded, cast, or extruded product. An advantage of the present invention is that it can be used to secure various fence members including split rail, logs, sized lumber, cables, hoses or panels to common rolled metal posts.

8 Claims, 3 Drawing Sheets

FENCE BRACKET

FIELD OF THE INVENTION

The present invention relates to a bracket for mounting fence systems, particularly for utilizing common rolled metal posts.

Background of the Invention

Steel posts having a T, H, U, I or angled cross-section are often used in fence building as inexpensive and easily installed posts, particularly for temporary fences such as snow fences, for dividing fields or marking grounds.

Fences including these posts have been limited by the difficulty of securing the fence material to the post. Commonly heavy gauge wire is used for this purpose. Whilst this is effective for netting or snow fencing, this is not satisfactory if rails or panels are to be secured. Preformed wire cages are known for securing rails to rolled metal fence posts as disclosed in U.S. 4,688,769. However these cages must be exactly sized to accommodate particular fence members.

The present invention seeks to overcome these disadvantages by providing a bracket suitable for mounting various fence members securely, efficiently, and economically.

SUMMARY OF THE INVENTION

Accordingly, the present invention in a broad embodiment comprises a bracket for attaching at least one fence member to a fence post, wherein the fence post has a substantially flat front face having a width, and at least one rearwardly projecting apertured web, which bracket comprises a front plate, a first and second rear plate and a first and second mounting plate, wherein:

- the front plate is substantially wider than the width of the post front face, and is adapted to receive securing means for a fence member;
- the first rear plate is attached at a first lateral edge to a first lateral edge of the front plate, so as to extend substantially adjacent thereto, and is also adapted to receive at least one securing means for a fence member in registration with the front plate;
- the second rear plate is attached at a first lateral edge to a second lateral edge of the front plate, so as to extend substantially adjacent thereto; and
- each mounting plate extends rearwardly from the second lateral edges of the two rear plates, and each plate includes apertures in registration with the other;
- whereby the mounting plates are attachable to the apertured web to locate the front plate in an abutting relationship with the front face of the fence post; and whereby the front, rear, and mounting plates define a shaped slot adapted to receive the fence post, and when the bracket is mounted to the fence post, the post does not obstruct the fence member securing means.

It is contemplated within the present invention to provide a bracket in which the front plate is of sufficient width to extend beyond either one or both sides of the front face of the post. In an alternative embodiment the front plate is of sufficient width to extend to one side of the post, and the bracket is shaped to be reversible, so that it can be located on the fence post to extend to either side thereof as desired.

In a preferred embodiment the securing means for securing fence members are apertures for use with appropriate fasteners.

In an alternative embodiment the securing means for securing fence members comprise slots for receiving straps to engage the slots. These straps may be fastened together at their ends to form a loop, or may have notches or stops at their ends which retain them in the slots. A preferred strap for rapid assembly is an electrical cable tie.

The bracket is preferably a unitary member stamped from relatively heavy gauge sheet metal and bent to the desired shape. While bending, fold lines may be formed as sharply crimped lines or formed around a round or rectangular profile.

In a preferred embodiment the bracket is secured to a post with deformable plastic anchors engaging the holes in the mounting means and in the apertured web of the post.

In an alternative embodiment the bracket is formed of nylon or other suitable plastic, for example by injection moulding or by cutting an extrusion to appropriate length. If desired, a fiber reinforced plastic can be used. Similarly, the bracket can be fabricated as a metal casting in steel or a light metal such as an aluminum alloy. It can also be fabricated by cutting a metal extrusion, for example of an aluminum alloy, to appropriate length. The required apertures are provided by any suitable means.

In a more detailed broad embodiment the invention comprises a bracket for mounting fence members to the commonly used T-post having a substantially flat front face. Accordingly the bracket comprises a folded and perforated sheet metal strip of suitable length, breadth and thickness including a front plate, a first and a second rear plate, and a first and a second mounting plate:

- a first mounting plate apertured for securing to the web of the post;
- a first rear plate joined to the first mounting plate by a first fold line;
- a front plate attached to the first rear plate by a second fold line, and having a width substantially wider than the face of the post, and perforated in the portion extending beyond the post front face to provide apertures adapted to receive securing means for a fence member;
- a second rear plate attached to the front plate at a third fold line, and including perforations cooperating with the apertures in the front plate adapted to receive securing means for a fence member; and
- a second mounting plate attached to the second rear plate at a fourth fold line, apertured in registration with the first mounting plate for securing the bracket to the web of the post;
- wherein the bracket as shaped by the fold lines defines a T-shaped slot adapted to receive a post.

An advantage of the bracket according to the present invention is that it can be used to secure various fence members including split rail, logs, sized lumber or panels to the common rolled metal posts, especially the common T-shaped posts, requiring relatively simple installation methods. In the assembled fence, the rails are securely attached to the posts. Nevertheless the fence can be dismantled relatively easily. Rolled metal posts fitted with brackets according to the present invention can also be used advantageously to support electrical cables, hoses, sign placards and other items.

BRIEF DESCRIPTION OF THE DRAWINGS

The present invention will be further understood from the following description with reference to the drawings in which.

DETAILED DESCRIPTION

Figure 1:
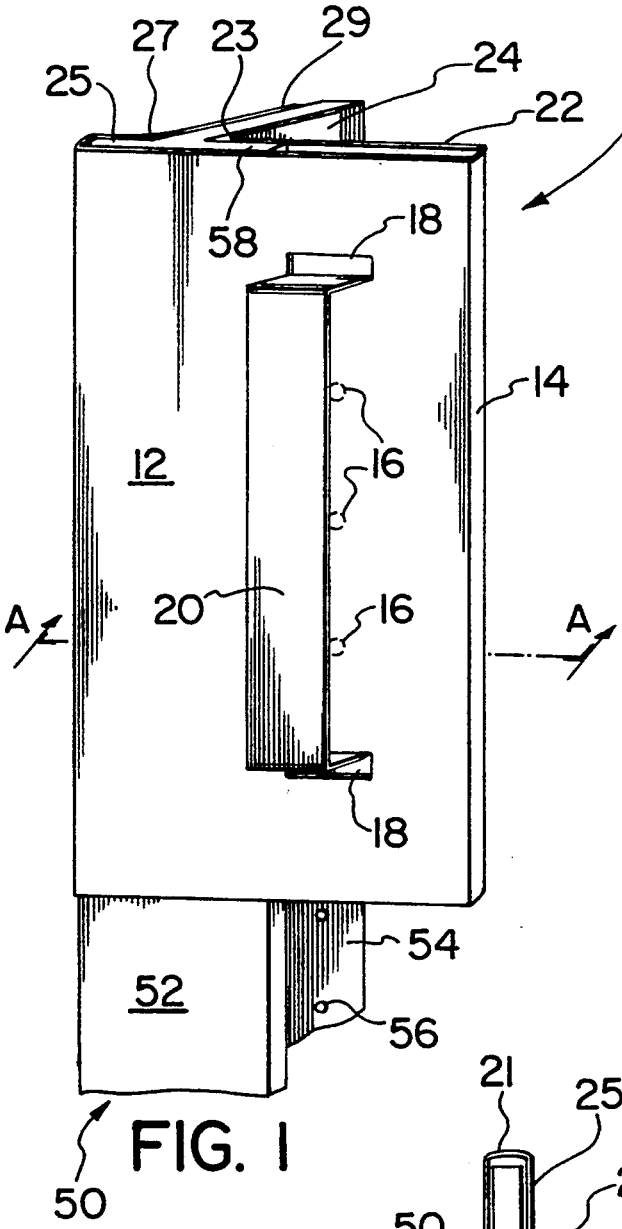
FIG. 1 illustrates a bracket mounted on a T-post.
Figure 3:
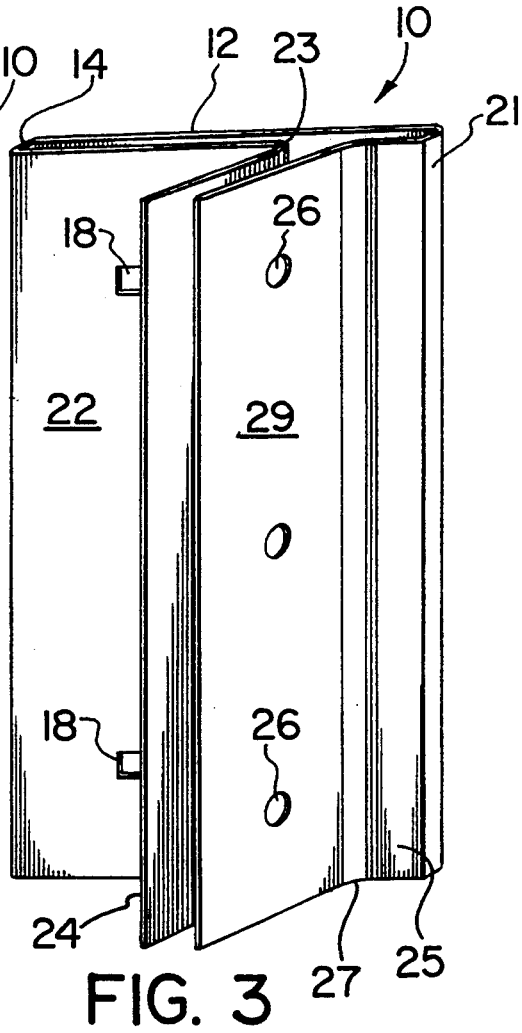
FIG. 3 illustrates the rear face of the bracket of FIG. 1.
Figure 2:
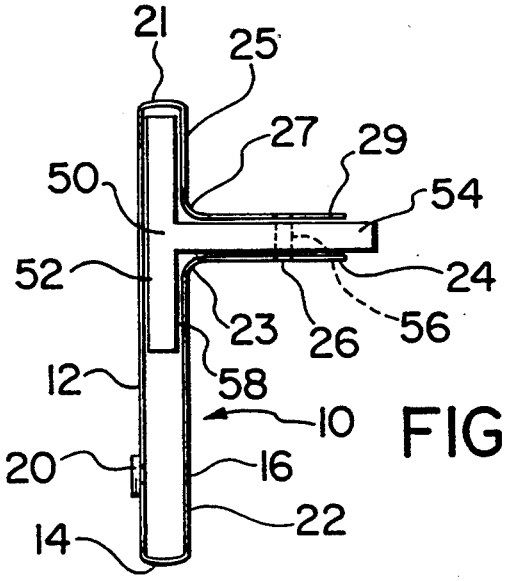
FIG. 2 illustrates a section taken on the line A—A in FIG. 1.

Referring first to FIGS. 1, 2 and 3 the bracket 10 is illustrated mounted on a T-post 50 having a substantially flat front face 52 and a rearwardly projecting apertured web 54 with holes 56. These posts are commonly used for temporary fencing, and are a rolled steel product. A spaced apart series of holes 56 are provided in the web of the post during manufacture. The bracket 10 as shown is a sheet metal product obtained by stamping out a blank of suitable length, breadth, and thickness, and folding it. The bracket includes a front plate 12 extending beyond the width of the post front face 52. The plate 12 has provision for securing fence members, including apertures 16, slots 18 and a detachable strap 20. The rear face 22, attached to the front plate 12 by the fold line 14, butts against the inner face 58 of the post 50. Apertures 16 and slots 18 penetrate the rear face 22 also. The rear face 22 is connected to mounting plate 24 at the fold line 23. The mounting plate 24 includes apertures 26 as shown in FIG. 2 which cooperate with holes 56 in the apertured web 54 of the post 50 for receiving fasteners to attach the bracket to the post.

As can be more clearly seen in FIG. 2, at the other side of the front plate 12 there is a second rear face 25 attached to the front plate 12 at the fold line 21. A second mounting plate 29 is attached to the second rear face 25 at the fold line 27. It can thus be seen that the bracket 10 engages all of the front face 52, and both of the side faces of the apertured web 54. The bracket 10 is attached to the post 50 by inserting suitable holding means, as will be discussed below, through the cooperating apertures 26 and 56.

Figure 4:
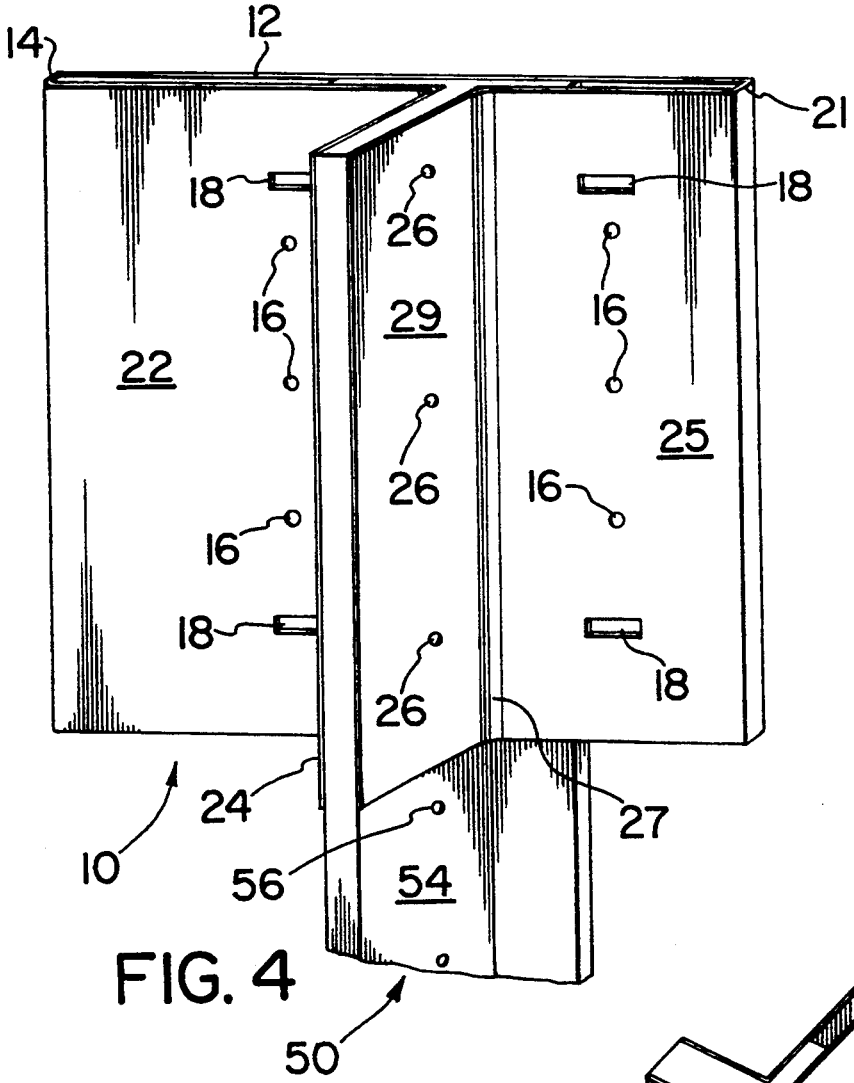
FIG. 4 illustrates a second form of bracket mounted on a T-post.
Figure 5:
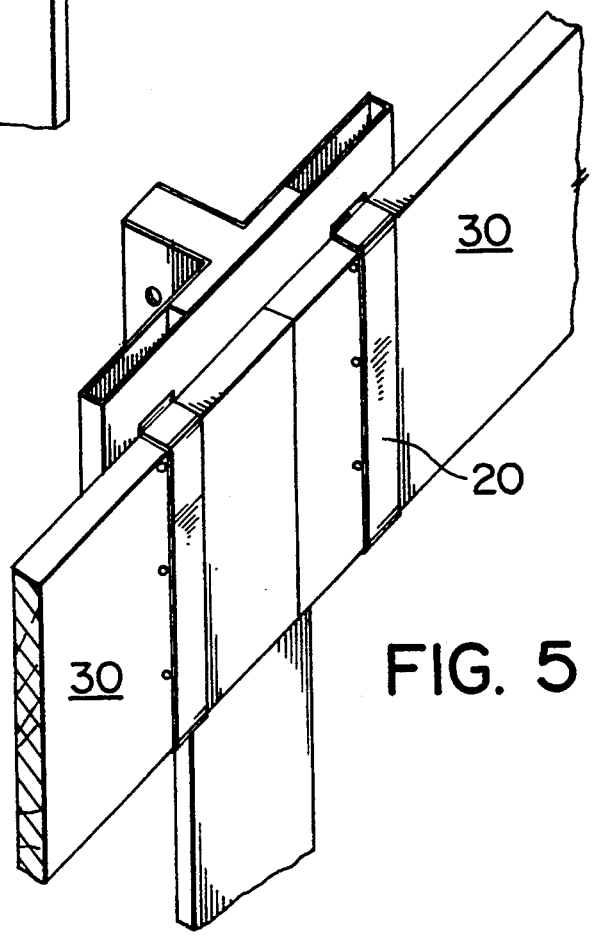
FIG. 5 illustrates two fence rails mounted on a T-post bracket secured with straps.

As shown in FIG. 4 the invention also contemplates a bracket in which the front face extends outwardly beyond both sides of the T-post 50. In this arrangement, there are conveniently two sets of apertures 16 and two sets of slots 18 for straps as at 20 in FIG. 1. This form of bracket is used to attach the ends of, for example, two fence rails to a single post, as is shown in FIG. 5. The two abutting fence rails 30 are secured by the straps 20 encircling the rails.

Figure 6:
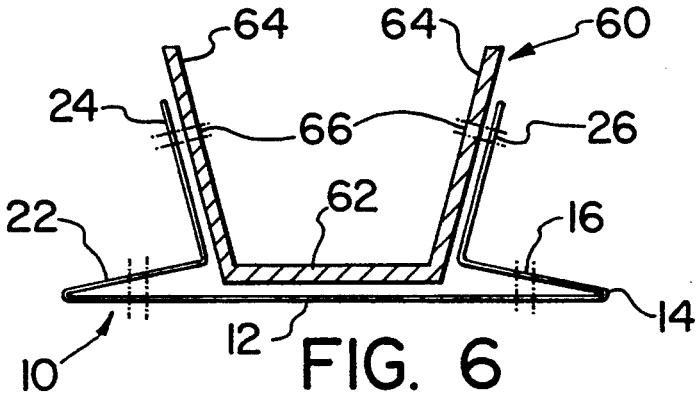
FIG. 6, 7 and 8 illustrate a bracket mounted on, and adapted for other varieties of commonly used posts shown in cross-section.

FIG. 6 illustrates an alternative embodiment of the bracket 10 adapted for a U-post 60 having a flat front face 62 and apertured webs 64 with holes 66. The bracket 10 includes a front plate 12 extending outwardly on both sides of the post front face 62. The front plate is similarly provided with securing means such as apertures and slots for straps to secure fence members. The rear plates 22 are folded back from the lateral edges of the front plate 12. The rear plates 22 are connected by fold lines to mounting plates 24 which include apertures 26 which cooperate with the holes 66 in the apertured webs 64 for receiving fasteners.

Figure 7:
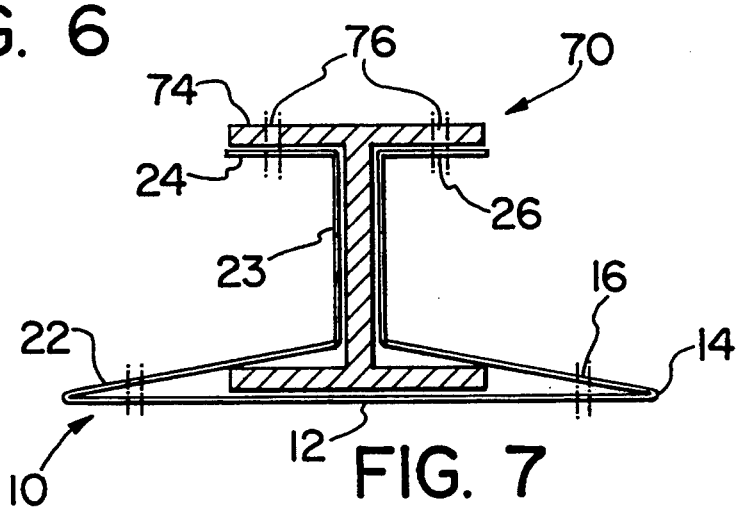

FIG. 7 illustrates another alternative embodiment of the bracket 10 adapted for an I-post 70 having a flat front face 72 and apertured webs 74 with holes 76. The bracket 10 includes a front plate 12 extending outwardly on either side of the front face 72. The front plate is similarly provided with securing means such as apertures and slots for straps to secure fence members. Rear faces 22 and mounting plates 24 are similarly folded back from the lateral edges of the front plate. Connecting segments 23 connect the rear faces 22 to the mounting portions 24, which include apertures 26 which cooperate with the holes 76 in the apertured webs 74 for receiving fasteners.

Figure 8:
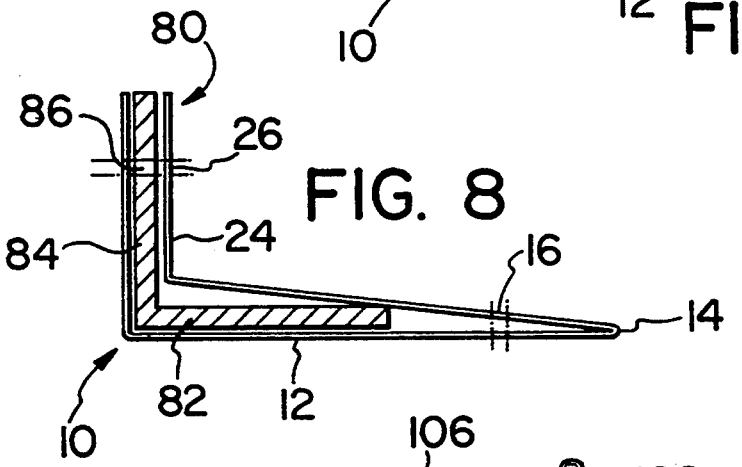

FIG. 8 illustrates a further alternative embodiment of the bracket 10 adapted for an angle post 80 having a flat front face 82 and an apertured web 84 with holes 86. The bracket 10 includes a front plate 12 extending beyond one side of the front face 82.

Figure 9:
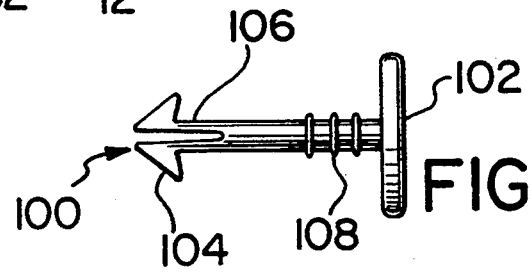
FIG. 9 illustrates a disposable plastic anchor for use in securing the bracket to a post.

In FIG. 9 is shown a deformable plastic anchor 100 which conveniently can be used to secure the bracket to a post. It is simply forced into the cooperating apertures, and if need be hammered home on the head 102. The barbs 104 on the legs 106 then engage onto the edges of the aperture. To detach the bracket, the head 102 is severed from the anchor, either with cutters or a claw hammer. If desired, ribs such as at 108 are also provided to improve the engagement of the anchor into the fence post, since the apertures provided in the post rear web tend to vary in size.

To secure the fence rails or other items, various fasteners can be used, such as wire or screw or bolt fasteners through the apertures 16. A convenient method for temporary fencing is to use an electrical cable tie of suitable length pulled tight through the holes 16 or the slots 18. Alternatively, the strap 20 can be provided with engagement means such as ribs or barbs to retain it in the slots 18. The form of fence rail attachment is chosen to fit the item being attached to the post.

In some of the embodiments shown, the bracket extends outwardly from only one side of the post. As the bracket is asymmetric, when inverted it extends in the other direction.

In all of the embodiments shown the front plate 12 can extend beyond one or both edges of the front face of the post. The front plate 12 is provided with securing means such as apertures 16 for fasteners and slots 18 for straps 20 to secure fence members. By folding back the rear face 22 from the front plate 12 significant stiffening of the bracket 10 is obtained. The mounting plates 24 in this case are also folded from the edge of the rear face 22. The mounting portions 24 include apertures 26 which cooperate with the holes in the apertured web for receiving fasteners.

Although in the preceding discussion only a sheet metal bracket is discussed, as is noted earlier it is contemplated that the bracket can be fabricated in other ways. It can be made from a plastic material, either as discrete injection molded parts, or by cutting suitable lengths from an extrusion. If desired, a fiber reinforced plastic can be used. Conveniently, recycled plastic material is useable. The bracket can also be fabricated from a metal, either by casting or by cutting sections from an extrusion. Suitable casting metals include mild steel and aluminum alloys, whilst aluminum alloys are suitable for making extrusions. The various holes, slots, and the like are provided in the finished bracket by any suitable means such as drilling, broaching, and the like.

In use the brackets can be mounted on posts before or after they have been set in the ground. The brackets are adjustable in height accordingly as holes in the posts are provided, permitting a variety of fence patterns. The single extension brackets are useful for the end of fence lines.

The embodiments of the invention to which an exclusive property or privilege is claimed are defined as follows:

1. A bracket for attaching at least one fence member to a fence post, wherein the fence post has a substantially flat front face having a width, and at least one rearwardly projecting apertured web, in which the bracket comprises a front plate, a first and second rear plate and a first and second mounting plate, wherein:

the front plate is substantially wider than the width of the post front face, and is adapted to receive securing means for a fence member, and has first and second lateral edges;

the first rear plate is attached to the first lateral edge of the front plate, such that the first rear extends substantially parallel to the front plate and terminates in a third lateral edge, and is also adapted to receive at least one securing means for the fence member in registration with the front plate;

the second rear plate is attached to the second lateral edge of the front plate, such that the Second rear plate extends substantially parallel to the front plate and terminates in a forth lateral edge; and each mounting plate extends rearwardly from the third and fourth lateral edges of each rear plate, and each of the mounting plates includes at least one aperture in registration with at least one aperture in the other mounting plate;

whereby the mounting plates are attachable to the apertured web to locate the front plate in an abutting relationship with the front face of the fence post; and whereby the front, rear, and mounting plates define a shaped slot receiving the fence post, and when the bracket is mounted to the fence post, the post does not obstruct the fence member securing means.

2. A bracket as claimed in claim 1 wherein two sets of securing means are provided one adjacent each lateral edge of the front plate.

3. A bracket as claimed in claim 1 wherein one set of securing means is provided adjacent one lateral edge of the front plate.

4. A bracket as claimed in claim 1 including apertures in the front plate to receive securing means for securing the fence members.

5. A bracket as claimed in claim 1 wherein the securing means for securing the fence members comprise slots in the front plate and a strap to engage the slots.

6. A bracket as claimed in claim 1 wherein the bracket is a unitary member stamped from sheet metal.

7. A bracket as claimed in claim 1 wherein the bracket is formed of a plastic.

8. A bracket for mounting fence members to a T-post having a substantially flat front face and an apertured web projecting rearwardly substantially perpendicularly from the centre of the front face, in which the bracket comprises a folded and perforated sheet metal strip of suitable length, breadth and thickness including a front plate, a first and a second rear plate, and a first and a second mounting plate:

a first mounting plate apertured for securing to the web of the post;

a first rear plate joined to the first mounting plate by a first fold line;

a front plate attached to the first rear plate by a second fold line, and having a width substantially wider than the face of the post, and perforated in the portion extending beyond the post front face to provide apertures adapted to receive securing means for a fence member;

a second rear plate attached to the front plate at a third fold line, and including perforations cooperating with the apertures in the front plate adapted to receive securing means for a fence member; and a second mounting plate attached to the second rear plate at a fourth fold line, apertured in registration with the first mounting plate for securing the bracket to the web of the post;

wherein the bracket as shaped by the fold lines defines a T-shaped slot receiving the T-shaped post.

* * * * *